US011092319B2

(12) United States Patent
Béland et al.

(10) Patent No.: US 11,092,319 B2
(45) Date of Patent: Aug. 17, 2021

(54) MOUNT INTERFACE FOR LIGHT FIXTURES

(71) Applicant: AXIS LIGHTING INC., Lasalle (CA)

(72) Inventors: Stephane Béland, Lasalle (CA); Jamie Katz, Lasalle (CA); Andrew Miles, Lasalle (CA); Howard Yaphe, Lasalle (CA)

(73) Assignee: Axis Lighting Inc., LaSalle (CA)

( * ) Notice: Subject to any disclaimer, the term of this patent is extended or adjusted under 35 U.S.C. 154(b) by 0 days.

(21) Appl. No.: 16/723,665

(22) Filed: Dec. 20, 2019

(65) Prior Publication Data

US 2020/0200372 A1 Jun. 25, 2020

Related U.S. Application Data

(63) Continuation-in-part of application No. 16/599,489, filed on Oct. 11, 2019.
(Continued)

(51) Int. Cl.
*F21V 21/03* (2006.01)
*F21S 8/04* (2006.01)
(Continued)

(52) U.S. Cl.
CPC ..... *F21V 21/03* (2013.01); *B25B 5/02* (2013.01); *F21S 8/043* (2013.01); *F21V 21/108* (2013.01); *F21V 21/14* (2013.01); *F21V 21/34* (2013.01)

(58) Field of Classification Search
CPC ..... F21V 21/03; F21V 21/108; F21V 21/14; F21V 21/34; B25B 5/02; F21S 8/043
See application file for complete search history.

(56) References Cited

U.S. PATENT DOCUMENTS 6,464,179 B1 10/2002 Bulvan
6,702,453 B2 3/2004 Weedon
(Continued)

OTHER PUBLICATIONS

Esse-Ci Srl, ISDI_DIAMANTE (To the best of the Applicant's knowledge and understanding, the reference does not have a specific publication date but is believed to have been known by the Applicant on or after Dec. 1, 2017. Applicant believes it may have been available before the priority date of the application because the earliest date relating to this material that could be located online is Apr. 2017).

(Continued)

*Primary Examiner* — Mary Ellen Bowman
(74) *Attorney, Agent, or Firm* — Barnes & Thornburg LLP

(57) ABSTRACT

A device for mounting a light fixture structure to a ceiling grid. The device includes an anchor structure extending from the light fixture structure, with a pair of arm structures spaced to receive a ceiling grid segment therebetween at an anchor location on the ceiling grid adjacent a lower region of the ceiling grid. The arm structures have respective distal regions configured to be accessible from an upper region of the ceiling grid and a clamp structure configured to traverse laterally relative to the distal regions to couple with the respective distal end regions and thereafter to be transferable between a released position and a locked position. When in the locked position, the ceiling grid segment held between the anchor and clamp structures place the light fixture structure in the mounted position.

19 Claims, 17 Drawing Sheets

Related U.S. Application Data

(60) Provisional application No. 62/784,063, filed on Dec. 21, 2018, provisional application No. 62/820,083, filed on Mar. 18, 2019.

(51) Int. Cl.

| | |
|---|---|
| ***B25B 5/02*** | (2006.01) |
| ***F21V 21/14*** | (2006.01) |
| ***F21V 21/34*** | (2006.01) |
| ***F21V 21/108*** | (2006.01) |

(56) References Cited

U.S. PATENT DOCUMENTS

| | | | | |
|---|---|---|---|---|
| 7,293,895 | B2 | 11/2007 | Grossman et al. | |
| 7,735,794 | B1 | 6/2010 | Gretz | |
| 10,443,823 | B2 * | 10/2019 | Beland | E04B 9/006 |
| 2009/0296381 | A1 | 12/2009 | Dubord | |
| 2013/0050997 | A1 | 2/2013 | Bretschneider | |
| 2014/0226316 | A1 | 8/2014 | Medendorp | |
| 2015/0338068 | A1 | 11/2015 | Bolscher | |
| 2015/0364853 | A1 | 12/2015 | Thijssen et al. | |
| 2017/0082253 | A1 | 3/2017 | Sorensen et al. | |
| 2018/0313503 | A1 | 11/2018 | Sonneman | |
| 2020/0217488 | A1 * | 7/2020 | Beland | F21V 21/088 |

OTHER PUBLICATIONS

GES Lighting Track System, GES 1-Circuit Global Track System (To the best of the Applicant's knowledge and understanding, the reference does not have a specific publication date but is believed to have been known by the Applicant on or after Dec. 1, 2017. Applicant believes it may have been available before the priority date of the application because the earliest date relating to this material that could be located online is Jun. 2017).

Lighting Services Inc., Recessed Track Installation (2015).

Lumenalpha™ spot, 209272, lumenpulse Global Tek 100 track system installation instructions (2016).

Lytespan Track lighting 9100 (1999).

Philips, Lytespan, Basic, 1 Circuit Track 6000 (2015).

WAC Lighting, J Series 2 Circuit Track (2012).

* cited by examiner

MOUNT INTERFACE FOR LIGHT FIXTURES

CROSS REFERENCE TO RELATED APPLICATIONS

The disclosure claims priority benefit from the applications referenced below, and the disclosures set forth therein are incorporated herein by reference in their entities:

1. U.S. application Ser. No. 62/784,063, filed Dec. 21, 2018, entitled MOUNT INTERFACE FOR LIGHT FIXTURES
2. U.S. application Ser. No. 62/820,083, filed Mar. 18, 2019, entitled MOUNT INTERFACE FOR LIGHT FIXTURES.

The disclosures set forth in the applications referenced below are incorporated herein by reference in their entities:

1. U.S. application Ser. No. 16/256,356, filed Jan. 24, 2019, entitled COUPLERS FOR LIGHT FIXTURES;
2. U.S. application Ser. No. 16/146,631, filed Sep. 28, 2018, entitled CANOPY INTERFACE FOR A CEILING MOUNT;
3. U.S. application Ser. No. 15/885,742, filed Jan. 31, 2018, entitled CONDUIT ACCESS FOR LIGHT FIXTURES;
4. U.S. application Ser. No. 16/599,489, filed Oct. 11, 2019, entitled MOUNT INTERFACE FOR LIGHT FIXTURES;
5. the following U.S. design applications:
   a. application Ser. No. 29/664,989, filed Sep. 28, 2018, entitled LIGHT FIXTURE;
   b. application Ser. No. 29/664,461, filed Sep. 25, 2018, entitled LIGHT FIXTURE; and
   c. application Ser. No. 29/664,458, filed Sep. 25, 2018, entitled LIGHT FIXTURE COMPONENT.

FIELD OF THE DISCLOSURE

The present disclosure relates to light fixtures and associated structures.

BACKGROUND

Pendant light fixtures are typically mounted to ceilings, such as with a t-bar ceiling configurations, by way of a hanger clip and a suspension structure.

In contrast to pendant light fixtures, flush mount or fixed mount light fixtures are typically mounted directly against the ceiling by a threaded stud extending downwardly from a junction box or a t-bar clamp. Linear flush mount light fixtures have an array of passages therein requires a complementary array of studs in the ceiling. The task to align the passages in the light fixture with the corresponding supposedly aligned studs in known to be a tedious, if not time-consuming procedure, which is increasingly difficult to achieve with the increasing number mounting points and studs in the respective arrays.

It would thus be desirable to provide novel approaches for the mounting of light fixtures, or at least to provide the public with one or more useful alternatives.

SUMMARY

An aspect provides a device for mounting a light fixture structure to a ceiling grid, comprising an anchor structure configured to extend from the light fixture structure. The anchor structure has a pair of arm structures which are spaced to receive a ceiling grid segment therebetween at an anchor location on the ceiling grid and to be positionable with the light fixture structure in a mounted position adjacent a lower region of the ceiling grid. The arm structures have respective distal regions configured to be accessible from an upper region of the ceiling grid when the light fixture structure is in the mounted position. A clamp structure is configured to traverse relative to the distal regions to couple with the respective distal regions and thereafter to be transferable between a released position and a locked position, wherein in the locked position, the ceiling grid segment is held between the anchor and clamp structures thereby to place the light fixture structure in the mounted position.

In some example embodiments, the clamp structure is configured to traverse laterally relative to the distal regions along the upper region of the ceiling grid segment to couple with the respective distal regions.

In some example embodiments, the clamp structure is configured to engage the distal regions with relative movement along a travel path aligned with an upper surface of the ceiling grid segment.

In some example embodiments, the distal regions and the clamp structure include respective complementary coupling structures which are engageable via the relative sliding movement along the travel path.

In some example embodiments, the distal regions and the clamp structure include respective complementary coupling structures which are restricted for engagement via the relative movement along the travel path.

In some example embodiments, the complementary coupling structures provide respective male and female coupling structures on the clamp structure and/or the distal regions.

In some example embodiments, the clamp structure includes a clamp body, and the male structures include a pair of opposed outwardly extending tabs, and each of the distal regions include aligned female structures as passages with each open to receive a corresponding tab.

In some example embodiments, the clamp structure includes a latch movable relative to the clamp body with the opposed tabs integrated therewith, and a drive member configured to displace the latch relative to the clamp body.

In some example embodiments, the latch includes a pair of opposed neck regions respectively adjacent the tabs.

In some example embodiments, each of the passages includes a recess to receive a corresponding neck region in the locked position.

In some example embodiments, the clamp structure includes a pair of legs to engage toward and engage the upper surface of the ceiling grid segment.

In some example embodiments, each leg includes a saddle recess to receive the ceiling grid segment therein at the upper surface thereof.

In some example embodiments, each passage may include an opening toward the travel path to receive the corresponding tab and a barrier to limit further travel thereof once received in the passage.

In some example embodiments, at least one of the arm structures may include a passage to receive a tension member for securing the anchor structure to a ceiling structure above and/or adjacent the ceiling grid.

In some example embodiments, the at least one arm structure may have one or more boundaries, and an offset web portion extending outwardly from at least one of the one or more boundaries.

In some example embodiments, each of the arm structures may include a passage, the passages being aligned and laterally offset relative to the travel path and beyond a position in which each of the neck regions is aligned with a corresponding recess.

In some example embodiments, each passage may include an opening toward the travel path to receive the corresponding tab and a terminus to limit further travel beyond a location at which the neck region is aligned with the corresponding recess, and the corresponding passage is positioned beyond the terminus.

Another aspect provides a light fixture structure comprising mountable on a ceiling grid, comprising a housing structure. A pair of arm structures extend outwardly from the housing structure and are spaced to receive a ceiling grid segment therebetween at an anchor location on the ceiling grid and to be positionable with the light fixture structure in a mounted position adjacent a lower region of the ceiling grid. The arm structures have respective distal regions configured to be accessible from an upper region of the ceiling grid. A clamp structure is configured to traverse relative to the distal regions to couple with the respective distal regions and thereafter to be transferable between a released position and a locked position, wherein in the locked position, the ceiling grid segment is held between the anchor and clamp structures thereby to place the light fixture structure in the mounted position.

Another aspect provides a ceiling fixture structure mountable on a ceiling grid, comprising a housing structure, a pair of arm structures extending outwardly therefrom and which are spaced to receive a ceiling grid segment therebetween at an anchor location on the ceiling grid and to be positionable with the ceiling fixture structure in a mounted position adjacent a lower region of the ceiling grid. The arm structures have respective distal regions configured to be accessible from an upper region of the ceiling grid. A clamp structure is configured to traverse relative to the distal regions to couple with the respective distal regions and thereafter to be transferable between a released position and a locked position, wherein in the locked position, the ceiling grid segment is held between the anchor and clamp structures thereby to place the light fixture structure in the mounted position.

Another aspect provides a method for mounting a light fixture structure to a ceiling grid, comprising:

a) providing the light fixture structure and the clamp structure of any claim, aspect or example embodiment of the present disclosure or claims;
b) orienting the light fixture structure with the arm structures extending along opposite side surfaces of the ceiling grid segment to expose the distal regions above the upper region of the ceiling grid segment;
c) traversing the clamp structure in the released position, to engage the distal regions; and
d) transferring the clamp structure to the locked position.

BRIEF DESCRIPTION OF THE FIGURES

Several exemplary embodiments of the present disclosure will be provided, by way of examples only, with reference to the appended drawings, wherein.

DETAILED DESCRIPTION

Figure 1:
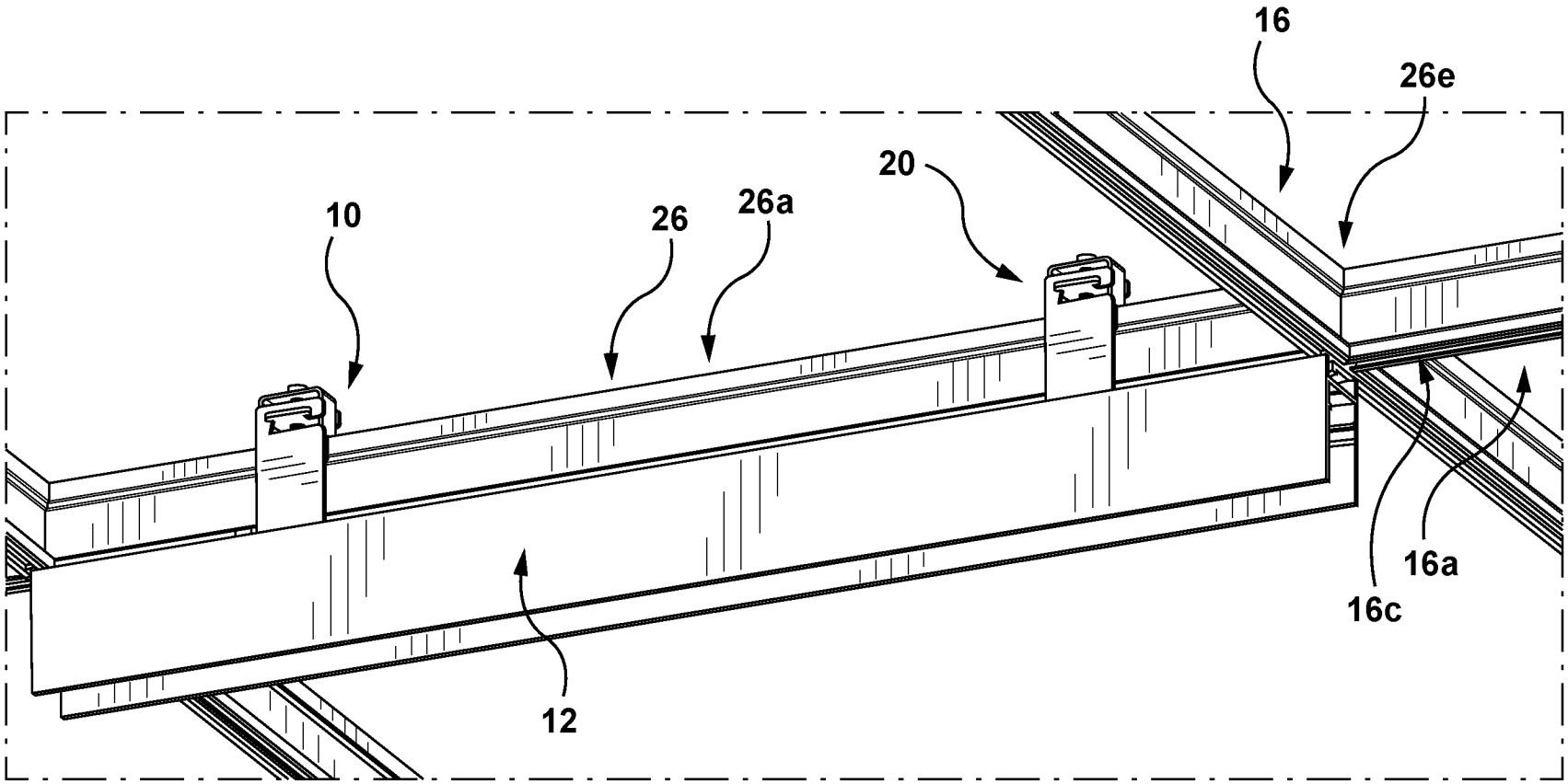
FIG. 1 is a fragmentary perspective view of a light fixture structure installed on a ceiling grid, in a position relative to a ceiling grid segment of a ceiling grid.

It should be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical, mechanical or other connections or couplings. The terms upper, lower, and vertical are intended for operative context only and are not necessarily intended to limit the invention only to those configurations or orientations. Furthermore, and as described in subsequent paragraphs, the specific mechanical and/or other configurations illustrated in the drawings are intended to exemplify embodiments of the invention. However, other alternative mechanical and/or other configurations are possible which are considered to be within the teachings of the instant disclosure.

Figure 2:
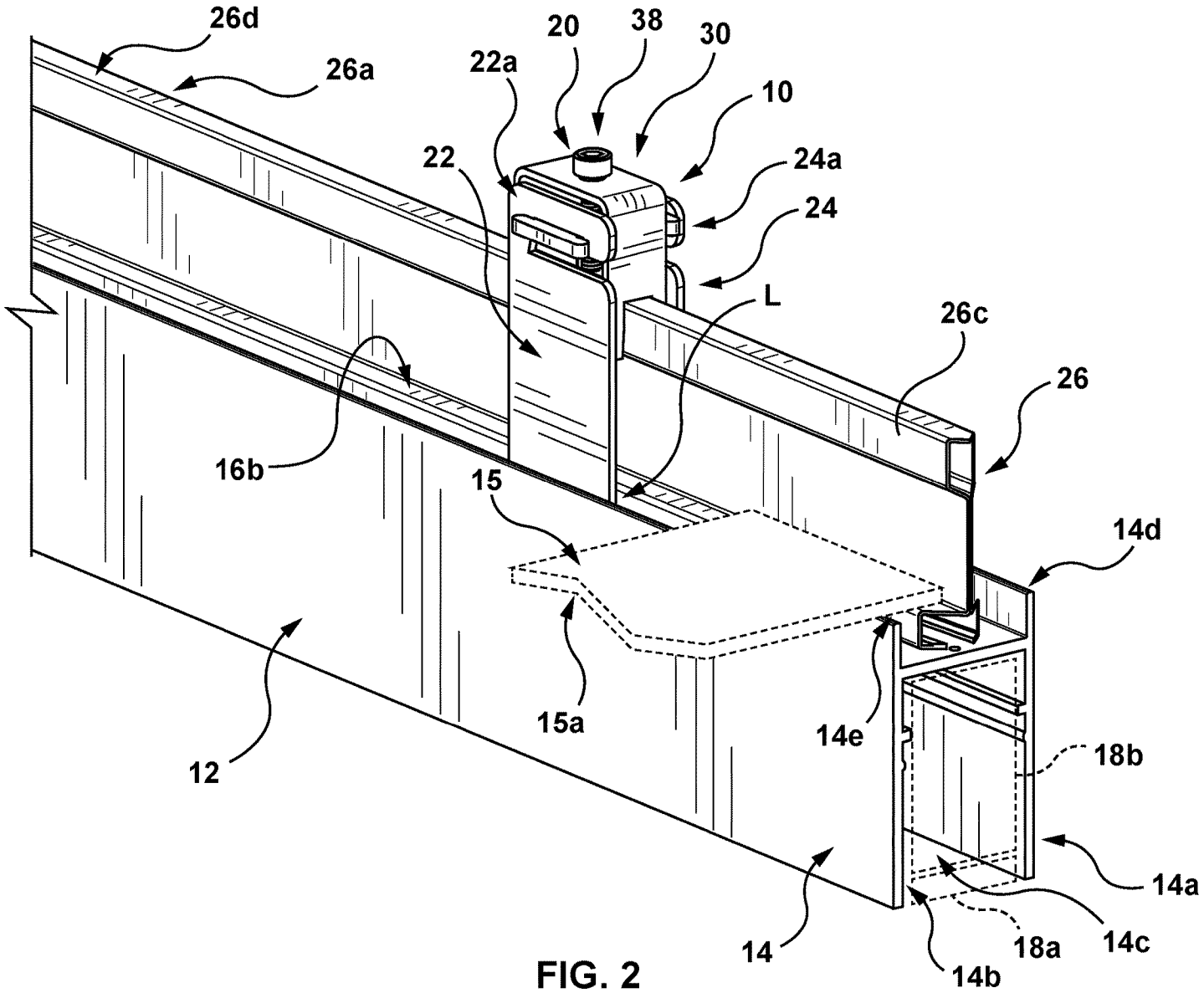
FIG. 2 is a magnified fragmentary perspective of a portion of the light fixture structure of FIG. 1 in another position relative to a ceiling grid segment of a ceiling grid.

Referring to the figures, there is provided a device 10 for mounting a ceiling structure, in this example embodiment in the form of a light fixture structure 12 to a ceiling grid 16. Referring to FIG. 2, the device 10 comprises an anchor structure 20 configured to extend from the light fixture structure 12, and which provides a pair of arm structures 22, 24 which are spaced to receive a ceiling grid segment 26 therebetween at an anchor location L on the ceiling grid 16. The anchor structure 20 is positionable with the light fixture structure 12 in a mounted position as shown in FIG. 1 adjacent a lower region 16*a* of the ceiling grid 16. In this example embodiment, the light fixture structure 12 is shown as a frame 14 formed of two boundaries 14*a*, 14*b* with an inner passage 14*c* to receive a lens and/or a light source or the like, as shown schematically at 18*a*, 18*b*, such as those provided by an LED array and a driver therefor.

Referring to FIG. 2, the frame has a pair of upper edge regions 14*d* and 14*e* which may be configured to engage an adjacent ceiling panel shown schematically at 15, when the frame 14 is in the position shown in FIG. 2, as may apply for example for ceiling configurations in which a lower surface 15*a* is substantially coplanar with a corresponding ceiling panel receiving surface 16*b*. Alternatively, the upper edge regions 14*d* and 14*e* may be configured to engage a lower boundary of the ceiling grid 16, as shown at 16*c* in FIG. 1, which may be configured with ceiling panels 15 which are shaped to extend or overhang below the lower boundary 16*c*. Both configurations may be controlled by the use of a controlled adjustment of the elevation of the light fixture structure 12 by way of one or more example embodiments as discussed below.

Figure 3:
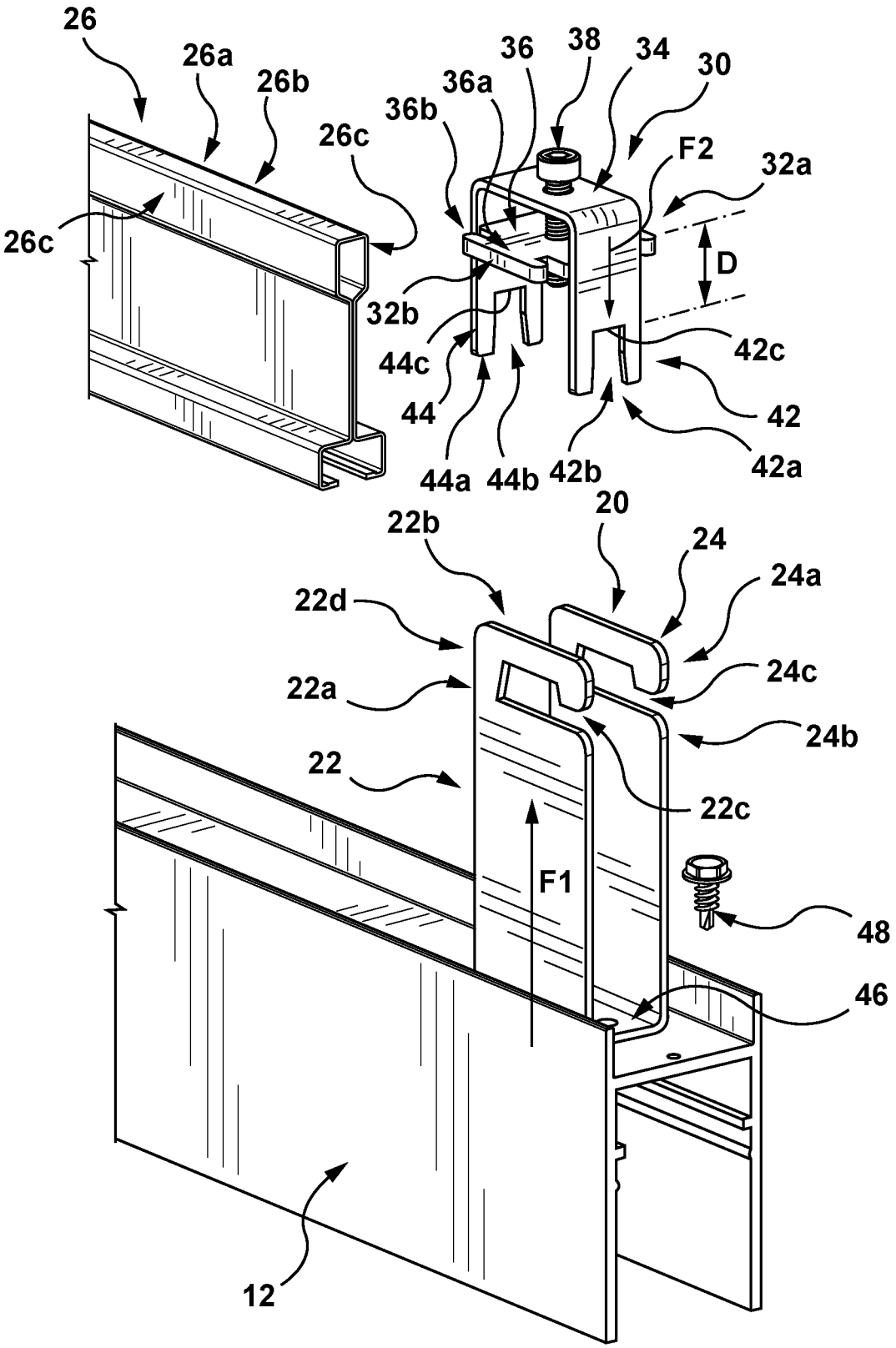
FIG. 3 is an exploded fragmentary perspective view of the light fixture structure of FIG. 2.
Figure 8:
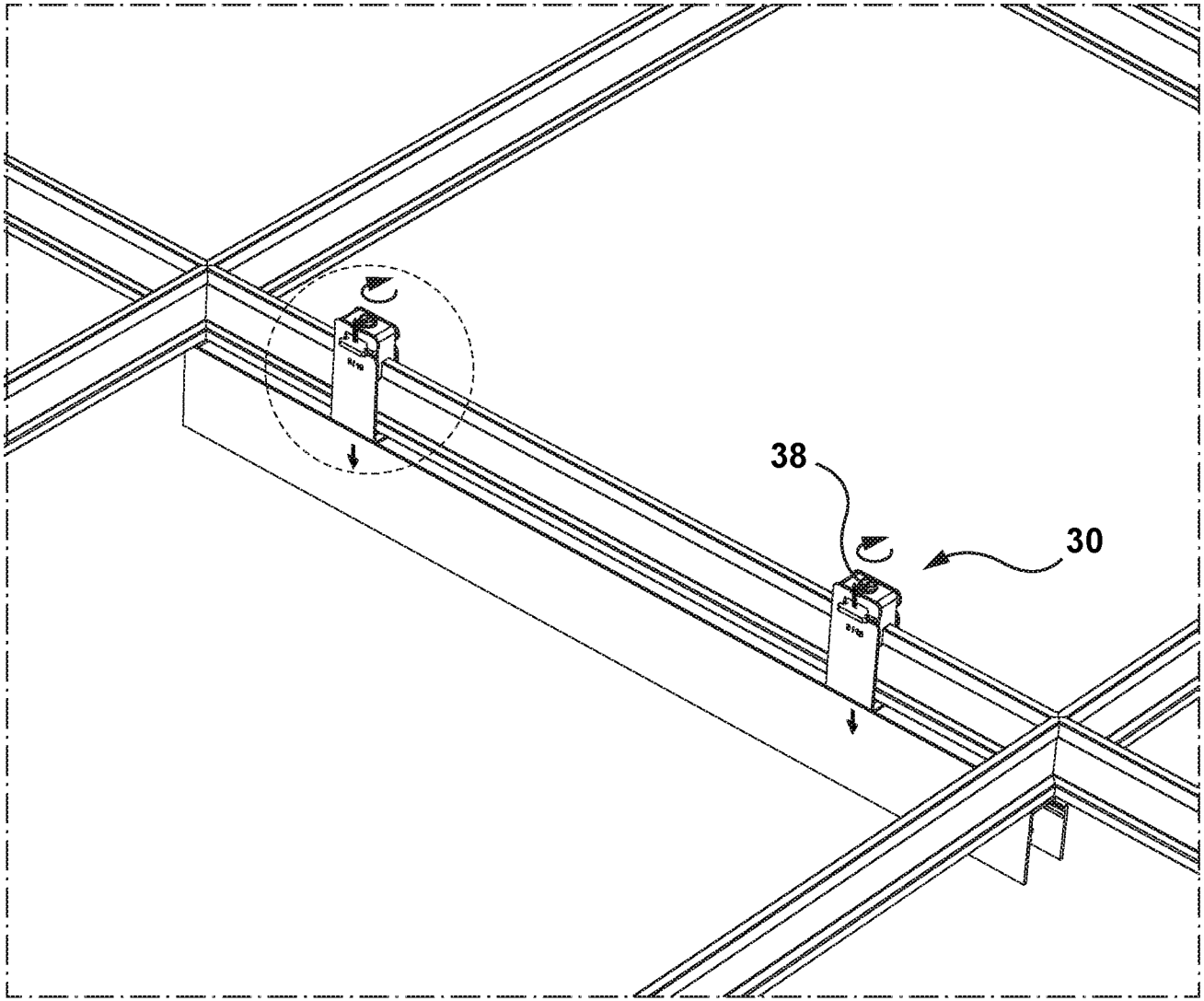
Figure 9:
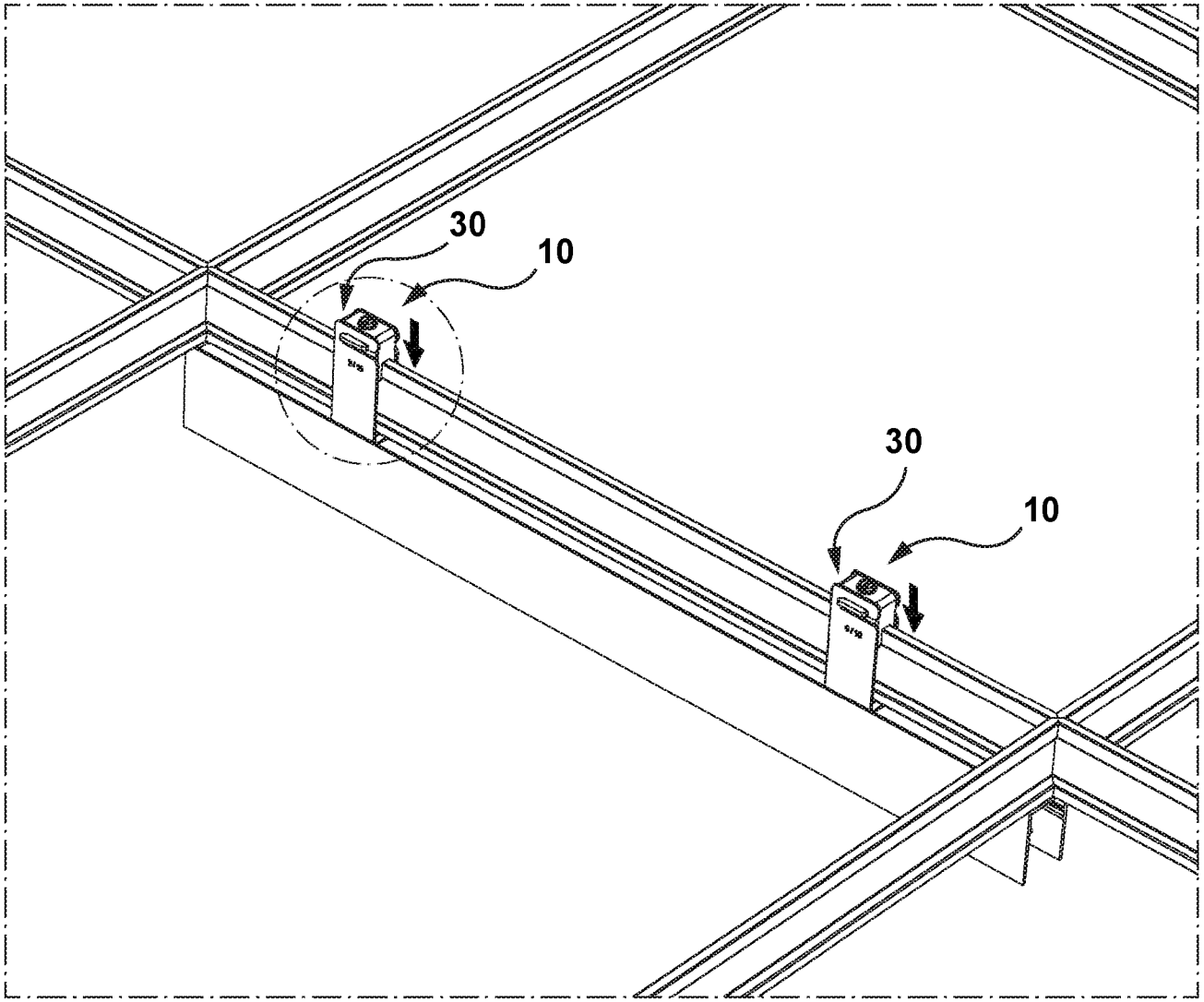
Figure 10:
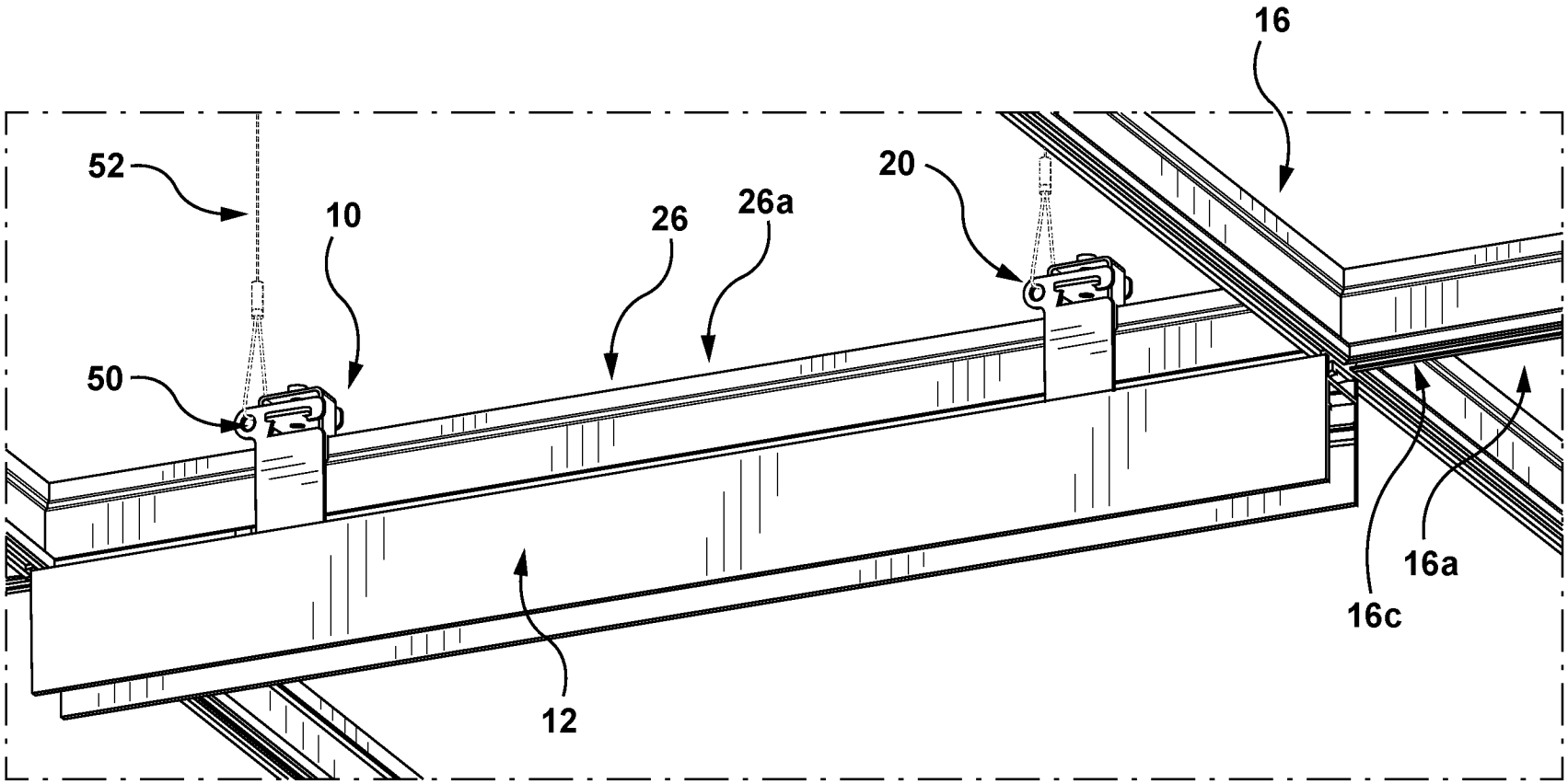
FIG. 10 is a perspective view of another light fixture structure installed on a ceiling grid.
Figure 11:
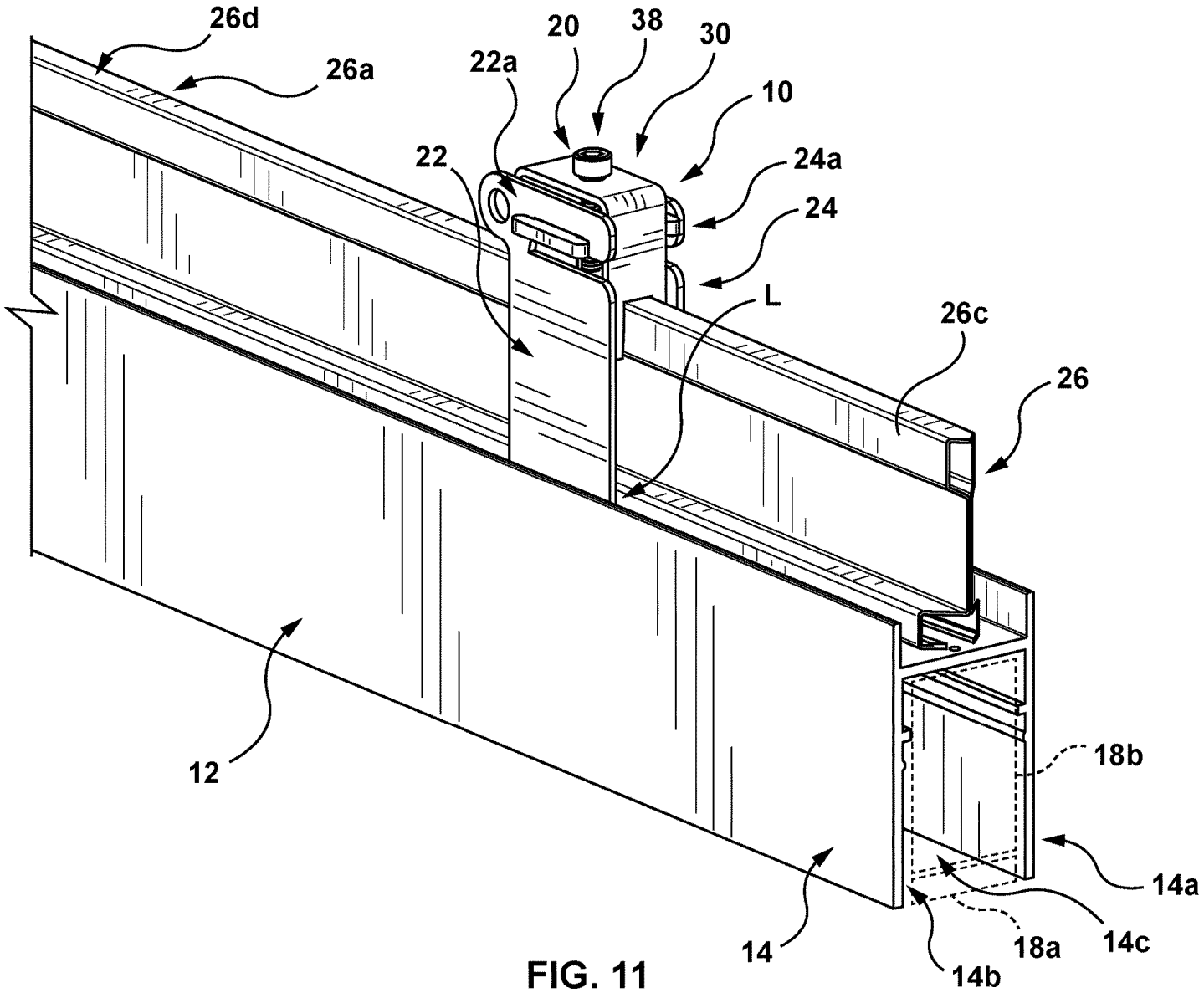
FIG. 11 is a magnified fragmentary perspective of a portion of the light fixture structure of FIG. 10.

Referring to FIG. 3, the arm structures 22, 24 have respective distal regions 22*a*, 24*a* which are configured to be accessible from an upper region of the ceiling grid 16, as can be seen in FIG. 1. A clamp structure is shown at 30 which is configured to traverse laterally relative to the distal regions 22*a*, 24*a* and along the upper region 26*a* of the ceiling grid segment 26 to couple with the respective distal end regions 22*a*, 24*a* and thereafter to be transferable between a released position (when viewed in FIG. 8) and a locked position (as shown in FIGS. 2 and 9) where the ceiling grid segment 26 is held between the anchor and clamp structures 20, 30, thereby to place the light fixture structure 12 in the mounted position.

Figure 7:
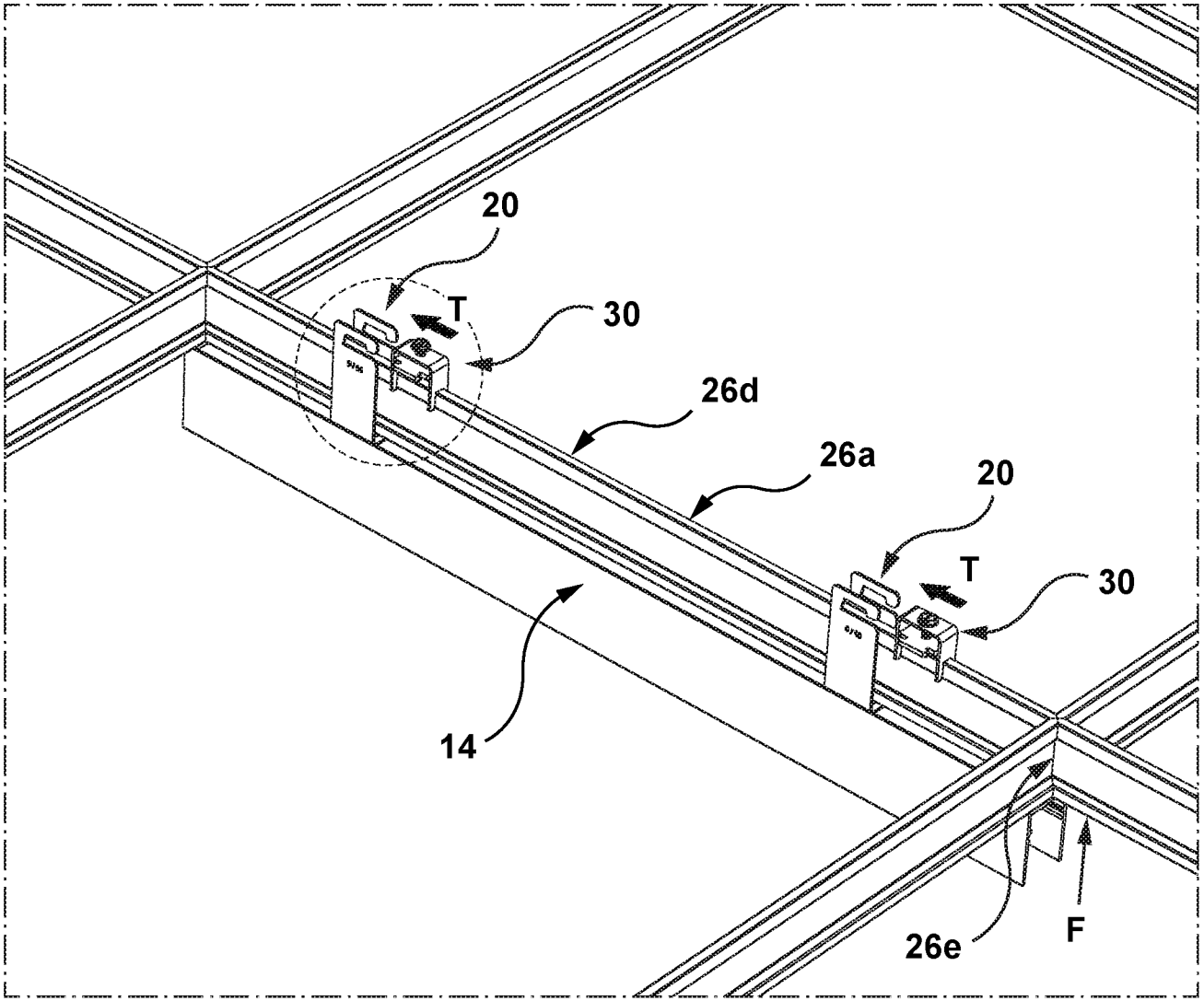

As can be seen in FIGS. 2 and 7, the clamp structure 30 may be configured to engage the distal regions 22*a*, 24*a* with relative sliding movement along a travel path T, which is aligned with an upper surface 26*d* of the ceiling grid segment 26. Further, as shown in FIG. 3, the distal regions 22*a*, 24*a* and the clamp structure 30 may include respective complementary coupling structures 22*b*, 24*b* and 32*a*, 32*b* which are engageable via the relative sliding movement along the travel path T.

In some example embodiments, the complementary coupling structures 22*a*, 24*b*, and 32*a*, 32*b* may be configured to be restricted to engagement via the relative sliding or other movement of the clamp structure 30 along the travel path T. The complementary coupling structures may provide respective male and female coupling structures on the clamp structure 30 and/or the distal regions. In other example embodiments, the coupling structures may be configured so as to provide engagement without the restriction that the clamp member be sliding along the travel path T.

Figure 4:
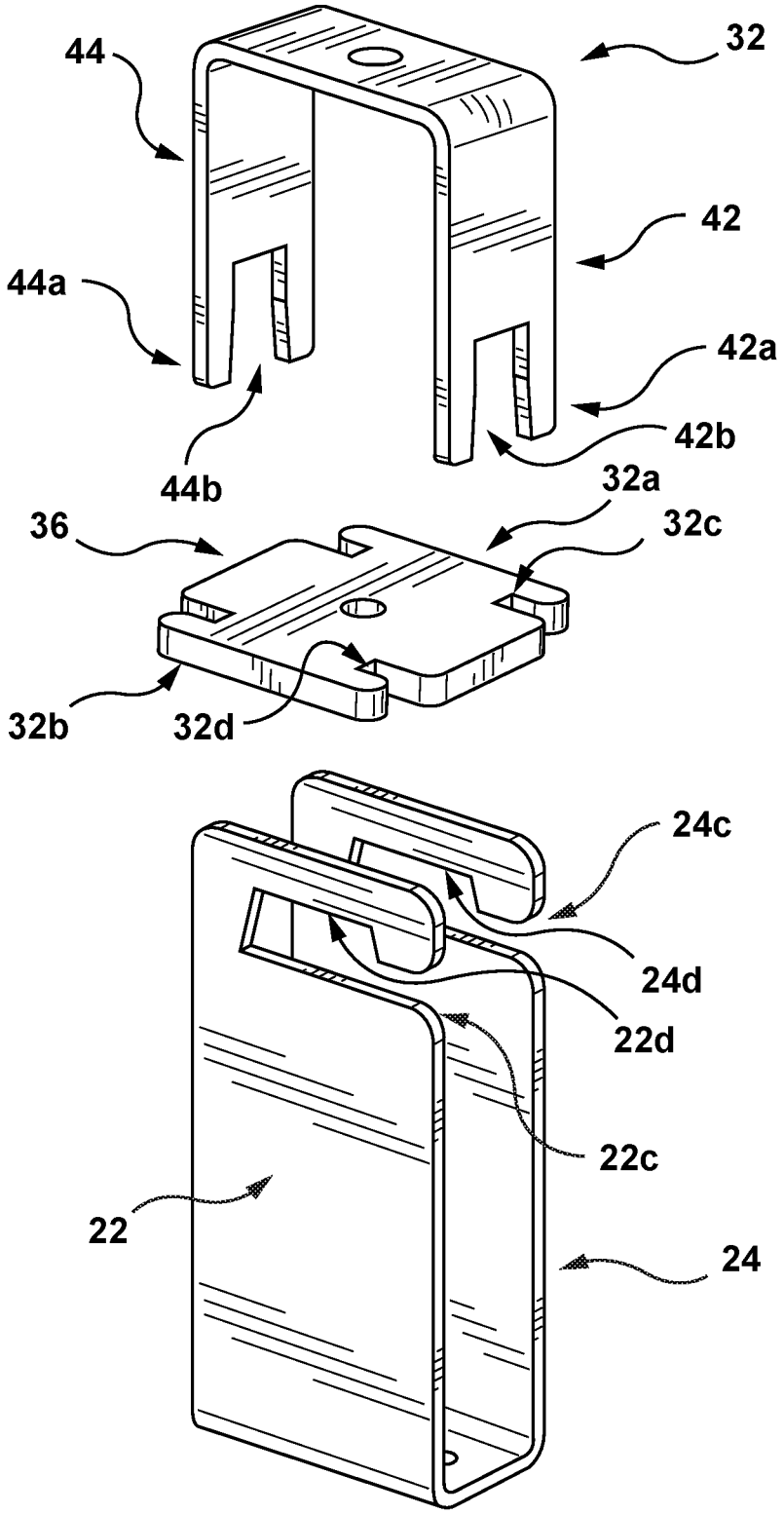
FIG. 4 is another exploded fragmentary perspective view of a portion of light fixture structure of FIG. 2.

Referring to FIGS. 3 and 4, the clamp structure 30 may include a clamp body 34, and the male structures may include the coupling structures 32*a*, 32*b* in the form of a pair of opposed outwardly extending tabs (also numbered 32*a*, 32*b*), and each of the distal regions 22*a*, 24*a* may include aligned female structures as passages, for example slots 22*c* and 24*c*, with each thereof open to receive a corresponding tab 32*a*, 32*b*. The clamp structure 30 may include a latch 36 which, in this example embodiment, has opposed end regions forming the tabs 32*a*, 32*b*. The clamp body 34 may include a pair of leg structures 42, 44 with distal regions 42*a*, 44*a* forming saddle recesses 42*b*, 44*b* which are shaped to engage the upper and opposed side surfaces 26*b*, 26*c* of the ceiling grid segment 26, as can be seen in FIG. 3. In other example embodiments, the male and female structures may be reversed, so that the outwardly extending tabs or other male structures, may be provided on the arm structures 22, 24 and the female structures may be provided on the latch 36 or other structures associated with the clamp.

Thus, the saddle recesses 42*b*, 44*b* enable the clamp structure 30 to positively engage the ceiling grid segment 26, while the tabs 32*a*, 32*b* positively engage the slots 22*c* and 24*c*. In this example embodiment, as shown in FIG. 4, each slot 22*c*, 24*c* is itself notched to form recesses 22*d*, 24*d* to receive a reduced neck region 32*c*, 32*d* of each tab to provide a positive locking coupling when the clamp structure 30 is in the locked position. A drive member 38 is also configured to displace the latch 36 relative to the clamp body 34 to increase the effective distance D between the uppermost edges 42*c*, 44*c* (as viewed in FIG. 3) in each saddle recess 42*b*, 44*b*, and a respective upper surface 36*a* of the latch 36, which has the effect of delivering an upward force F1 on the light fixture structure 12 and a downward force F2 on the leg structures 42, 44. Thus, the drive member 38 may provide a controlled adjustment of the elevation of the light fixture structure 12 while also providing a control of forces exerted on the light fixture structure 12 in the mounted position.

In some example embodiments, the anchor structure 20 may be provided with a base 46 to be fastened to a corresponding surface on the light fixture structure 12, by way of one or more fasteners 48, as can be seen in FIG. 3. Alternatively, the arm structures 22, 24 may be integrally formed with the light fixture structure. Still further, the anchor structure may be provided with other mounting platforms as needed to provide a mounting location for other ceiling mountable items, such as hooks, rods or the like.

Figure 5:
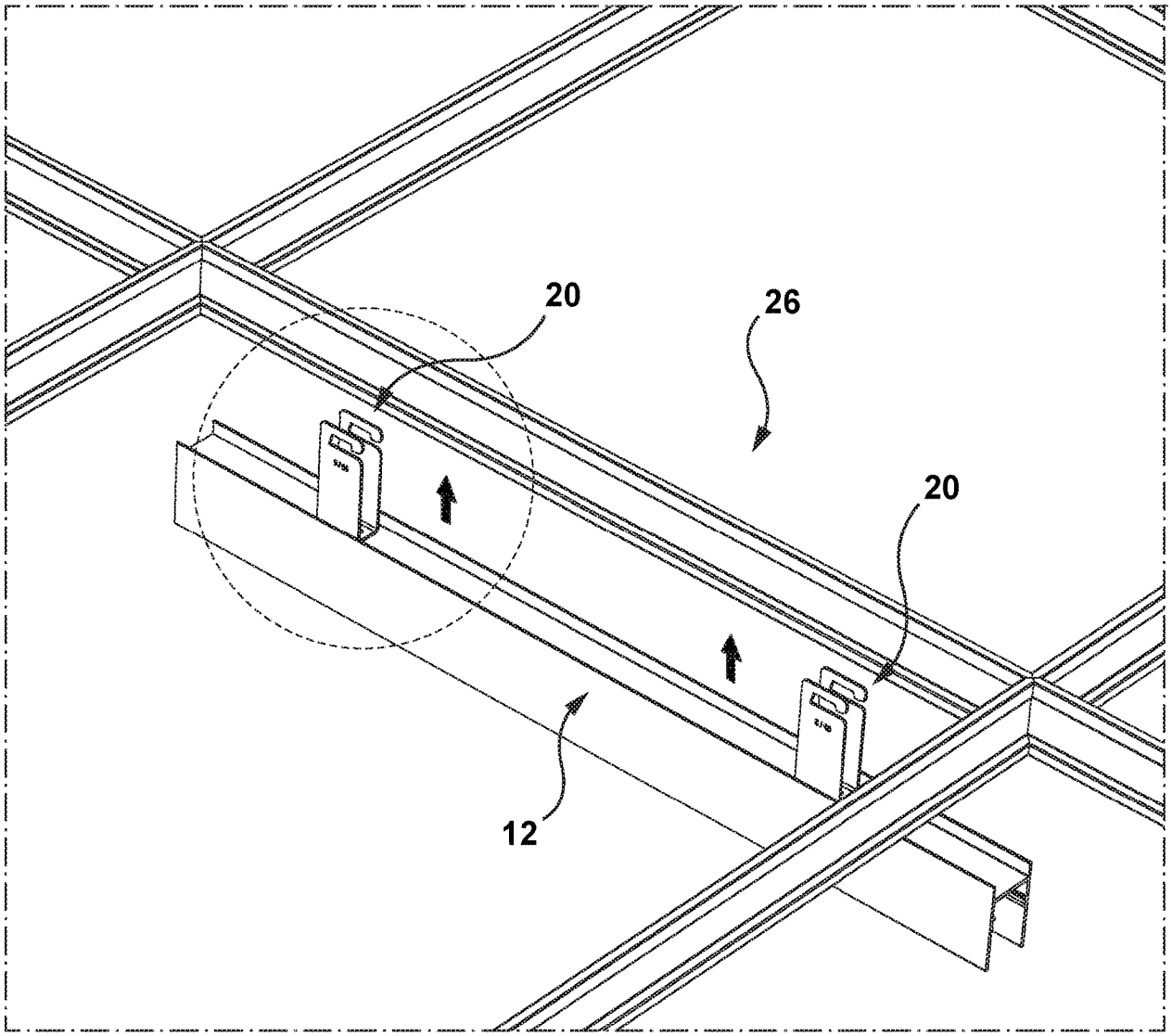
FIGS. 5 to 9 are progressive fragmentary perspective views of a method to install the light fixture structure of FIG. 1
Figure 6:
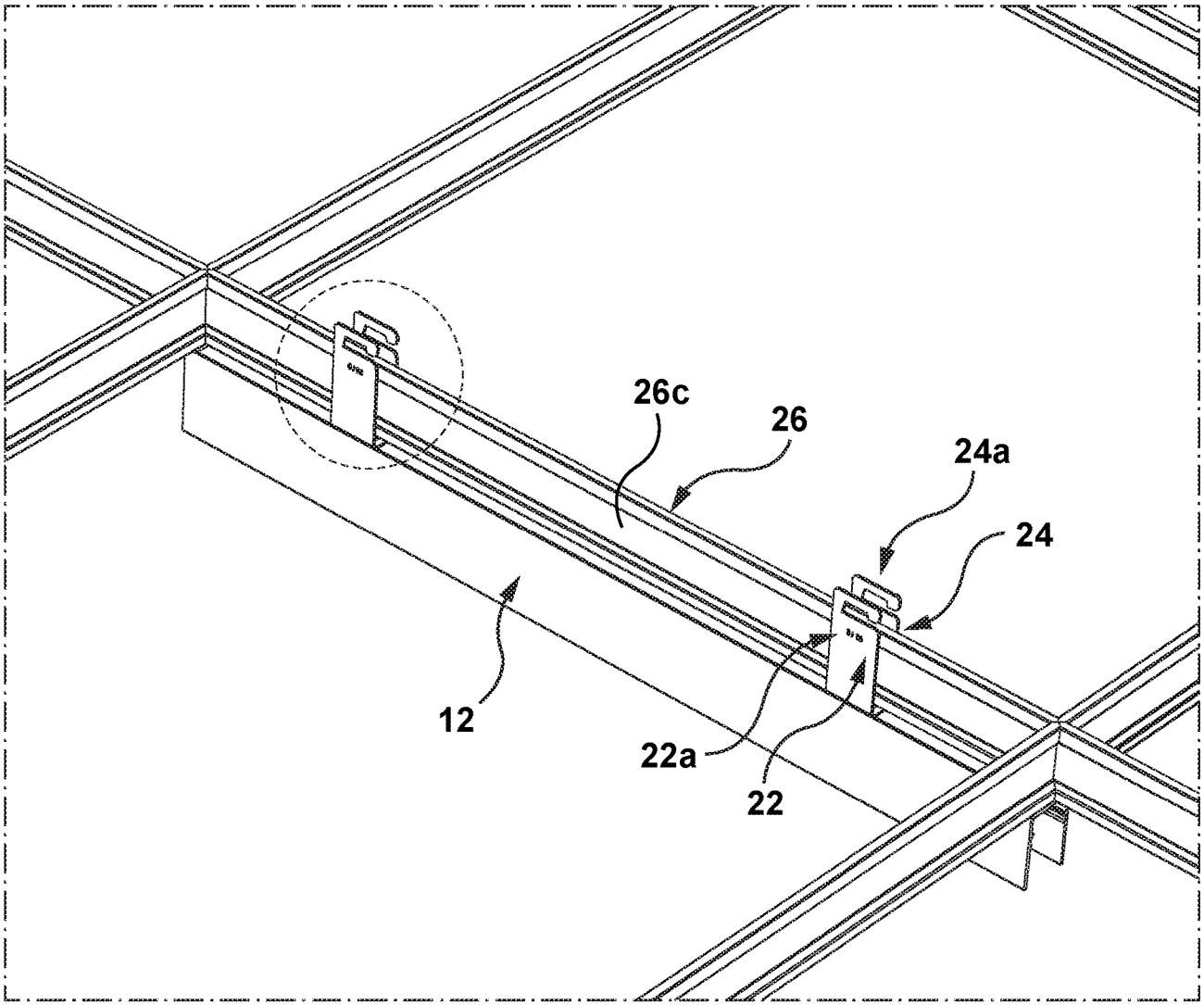

The light fixture structure may thus be installed as follows. First, the light fixture structure 12 may be provided with a sufficient number of spaced anchor structures 20, as for example two as shown in FIG. 5. The anchor structures 20 may then be aligned with respective one or more ceiling grid segments 26. As shown in FIG. 6, the light fixture structure 12 may then be manipulated to position the arm structures 22 along opposite side surfaces 26*c* of the ceiling grid segment 26 to expose the distal regions 22*a*, 24*a* above the upper region 26*a* of the ceiling grid segment 26. As shown in FIG. 7, a clamp structure 30 for each of the corresponding anchor structures 20 may then be slid, or otherwise traversed along the upper region 26*a* of the ceiling grid segment until the tabs 32*a*, 32*b* pass into the corresponding slots 22*c*, 24*c*. As shown in FIGS. 8 and 9, the clamp structure 30 may then be transferred from the released position to the locked position by rotating the drive member 38. In the course of doing so, the frame 14 may be elevated toward the lower boundary of the ceiling grid segment 26 until it makes contact therewith, as may occur if the light fixture structure 12 is positioned to engage the ceiling at a ceiling grid node (or intersection) of ceiling grid segments 26, as shown at 26*e* in FIG. 7. Alternatively, the light fixture structure 12 may be positioned so as not to engage any part of a ceiling grid segment 26 at the node 26*e*, in which case further elevation of the frame 14, by way of drive member 38, may be controlled as the upper edge regions 14*c* and 14*d* may bypass the node 26*e* and engage the lower surface 15*a* of the ceiling panel 15. Still other configurations may be provided by way of example embodiments herein which provide firm attachment of the light fixture structure 12 the ceiling grid 16 in a manner which can accommodate different elevational settings for the light fixture structure, thus expanding a range of installation specifications available. Further, example embodiments provide a mode to firmly install the light fixture structure 12 while accommodating variations in elevation, linearity and/or curvature requirements or issues that may arise in existing and/or new ceiling grid projects, while reducing or minimizing delays or complications to accommodate mounting misalignments in holes and the like that can arise from such installations.

FIGS. 10 to 22 show another example embodiment in which each slot 22*c*, 24*c* (or passage) includes an opening 22*e*, 24*e* toward the travel path to receive the corresponding tab 32*a*, 32*b* and a barrier 22*f*, 24*f* to limit further travel of the corresponding tab 32*a*, 34*b* once received in the slot (or passage). At least one, and in this case both, of the arm structures 22, 24 includes a passage 50 to receive a tension member 52 for securing the anchor structure to a ceiling structure above and/or adjacent the ceiling grid. The passage 50 may be provided in a tab or other structure to attach a cable or other tension member to secure the light fixture structure to an upper building structure. Thus, the tension member may be a cable, a chain, a rope, cable tie or the like.

Figure 12:
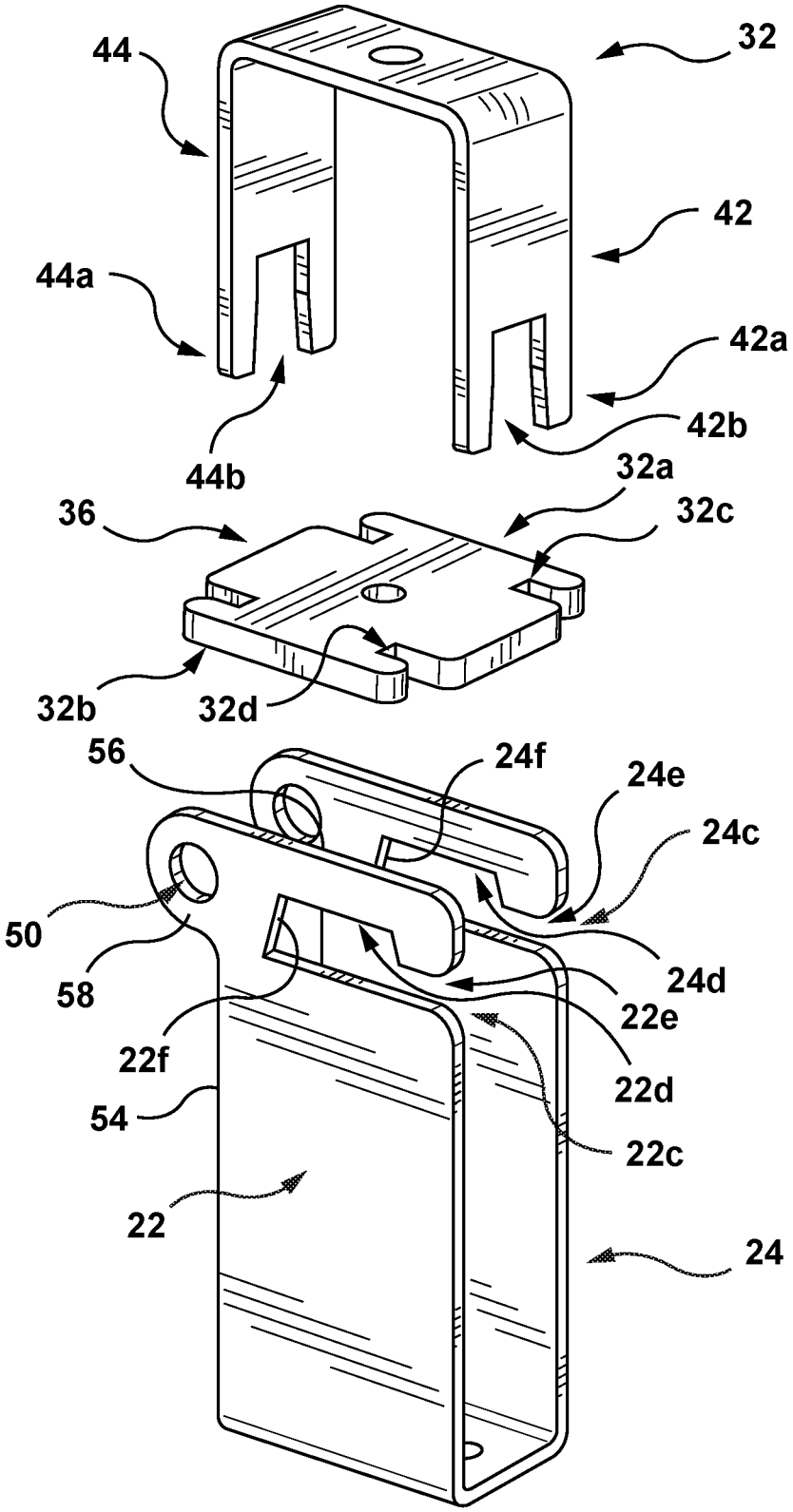
FIG. 12 is an exploded perspective view of a portion of light fixture structure of FIG. 11.
Figure 13:
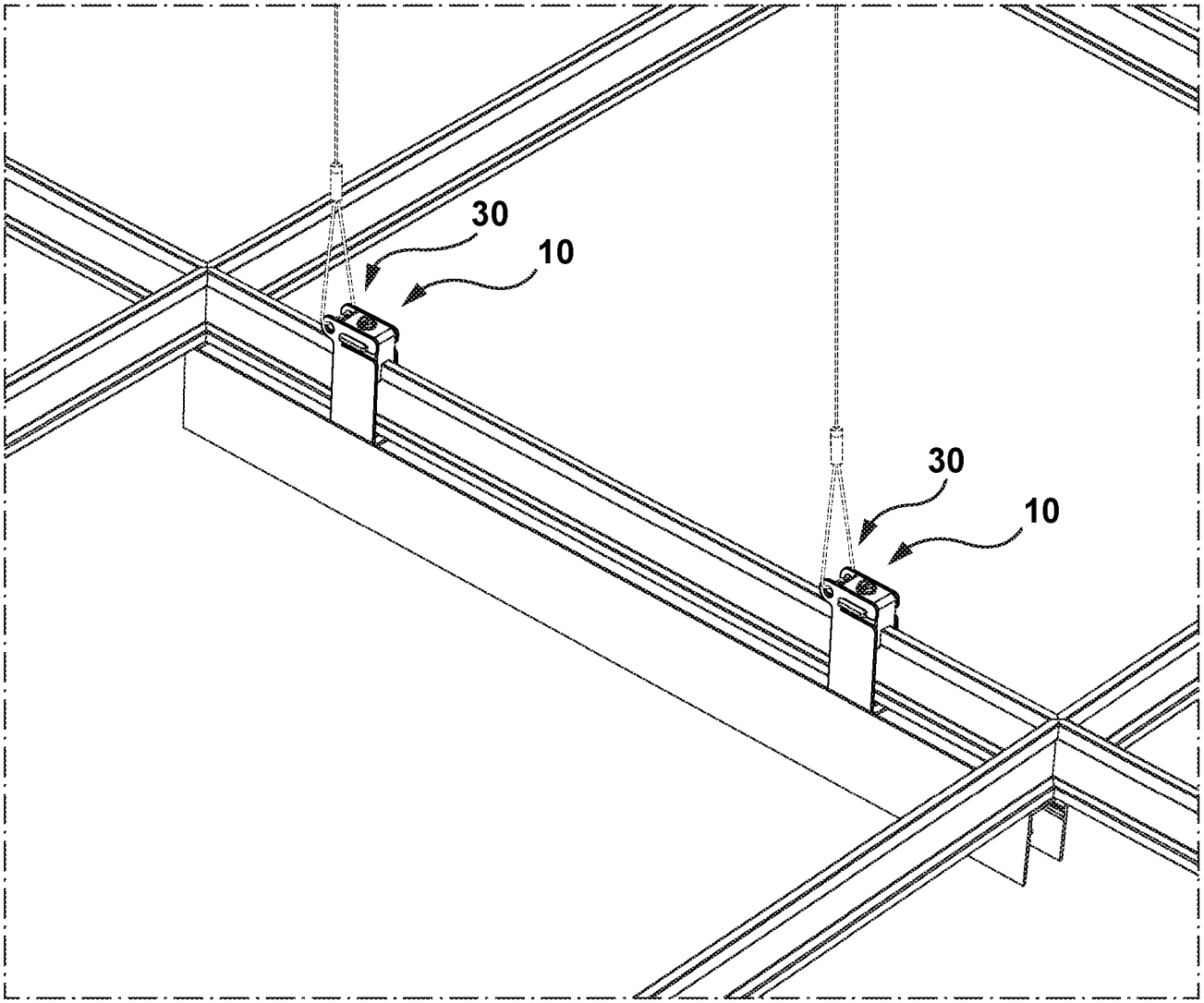
FIG. 13 is another perspective view of the light fixture structure of FIG. 10.
Figure 14:
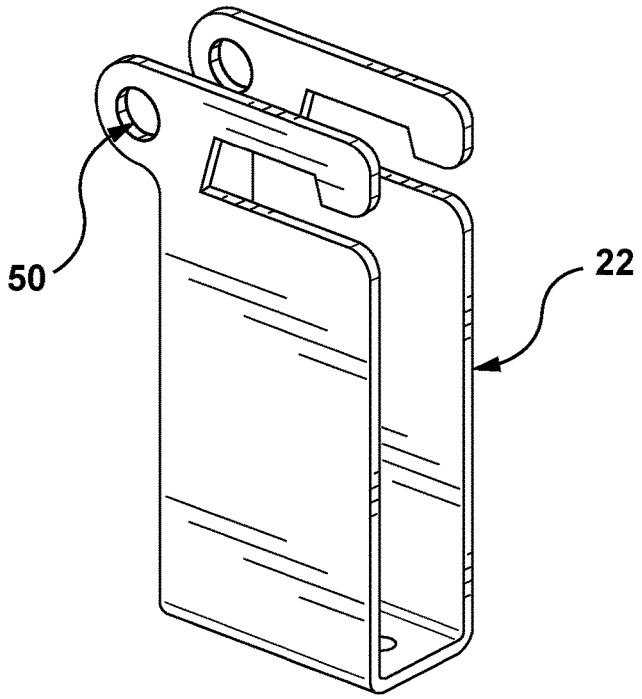
FIGS. 14 to 22 are views of an anchor structure component of the light fixture structure of FIG. 10.
Figure 15:
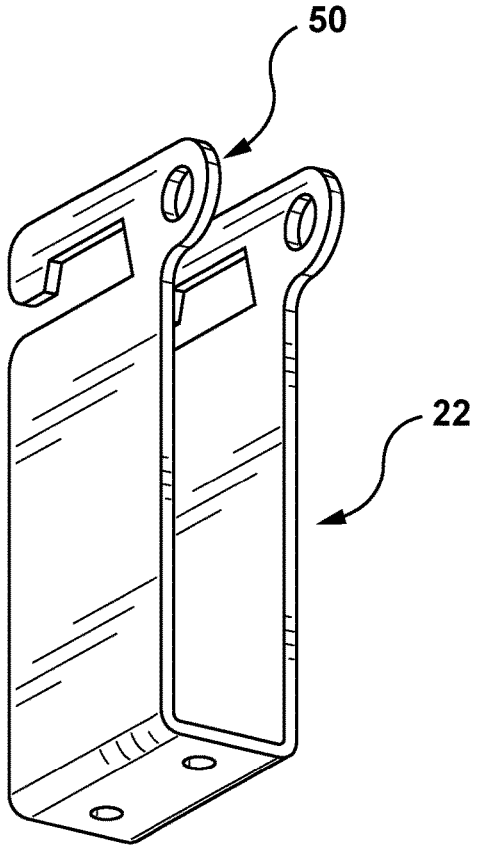
Figure 16:
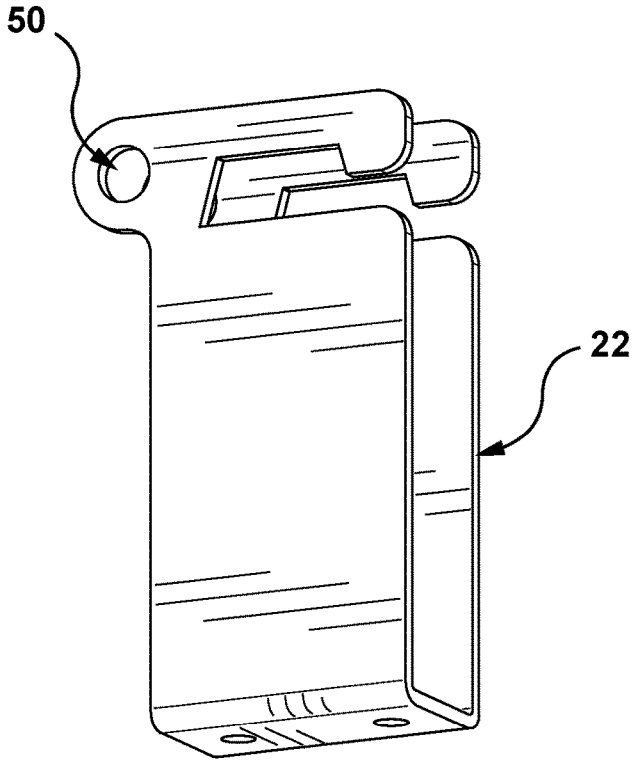
Figure 20:
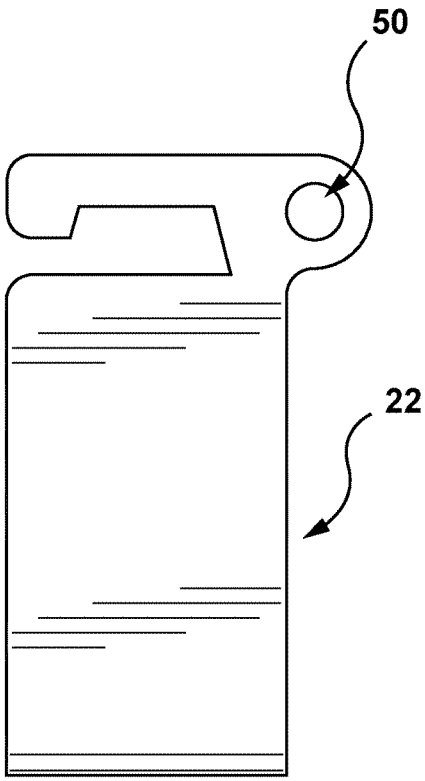
Figure 19:
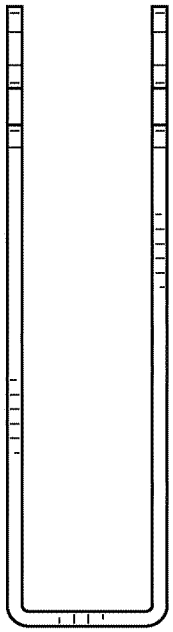
Figure 18:
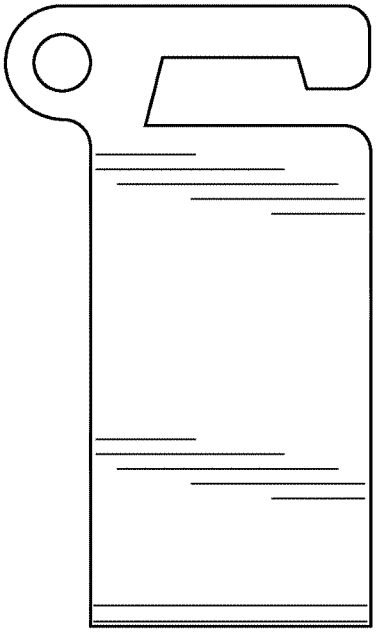
Figure 17:
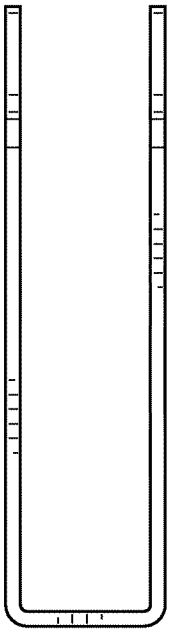
Figure 21:
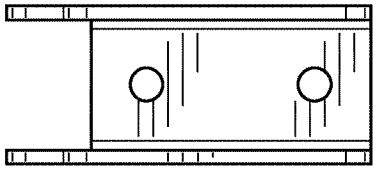
Figure 22:
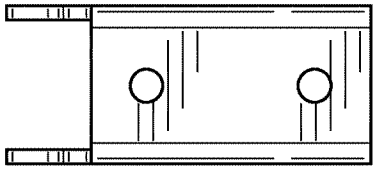

As can be seen in FIG. 12, each arm structure 22, 24 has one or more boundaries, in this case a longitudinal boundary 54 and an upper lateral boundary 56, along with an offset web portion 58 which extends outwardly from or beyond at least one of the boundaries 54, 56.

In some example embodiments, each of the arm structures 22, 24 may thus be configured, so that the passages 50 may be aligned and laterally offset relative to the travel path and beyond a position in which each of the neck regions 32*c*, 32*d* is aligned with a corresponding recess 22*d*, 24*d*. Each passage may thus include an opening 22*e*, 24*e* toward the travel path to receive the corresponding tab, and a terminus (or barrier) 24*f* to limit further travel beyond a location at which the corresponding neck region 32*c*, 32*d* is aligned with the corresponding recess 22*d*, 24*d*, and the corresponding passage 50 is positioned beyond the terminus 22*f*, 24*f*.

Thus, in some example embodiments, the offset portion 58 is shown to extend being the longitudinal boundary 54 and thus remain below the upper lateral boundary 56. In other configurations, the offset web portion 58 may extend above the upper lateral boundary 56, or in another configuration in which the passage 50 may receive the tension member 52 in a way which does not obstruct the interaction of the anchor and clamp structures.

Figure 23:
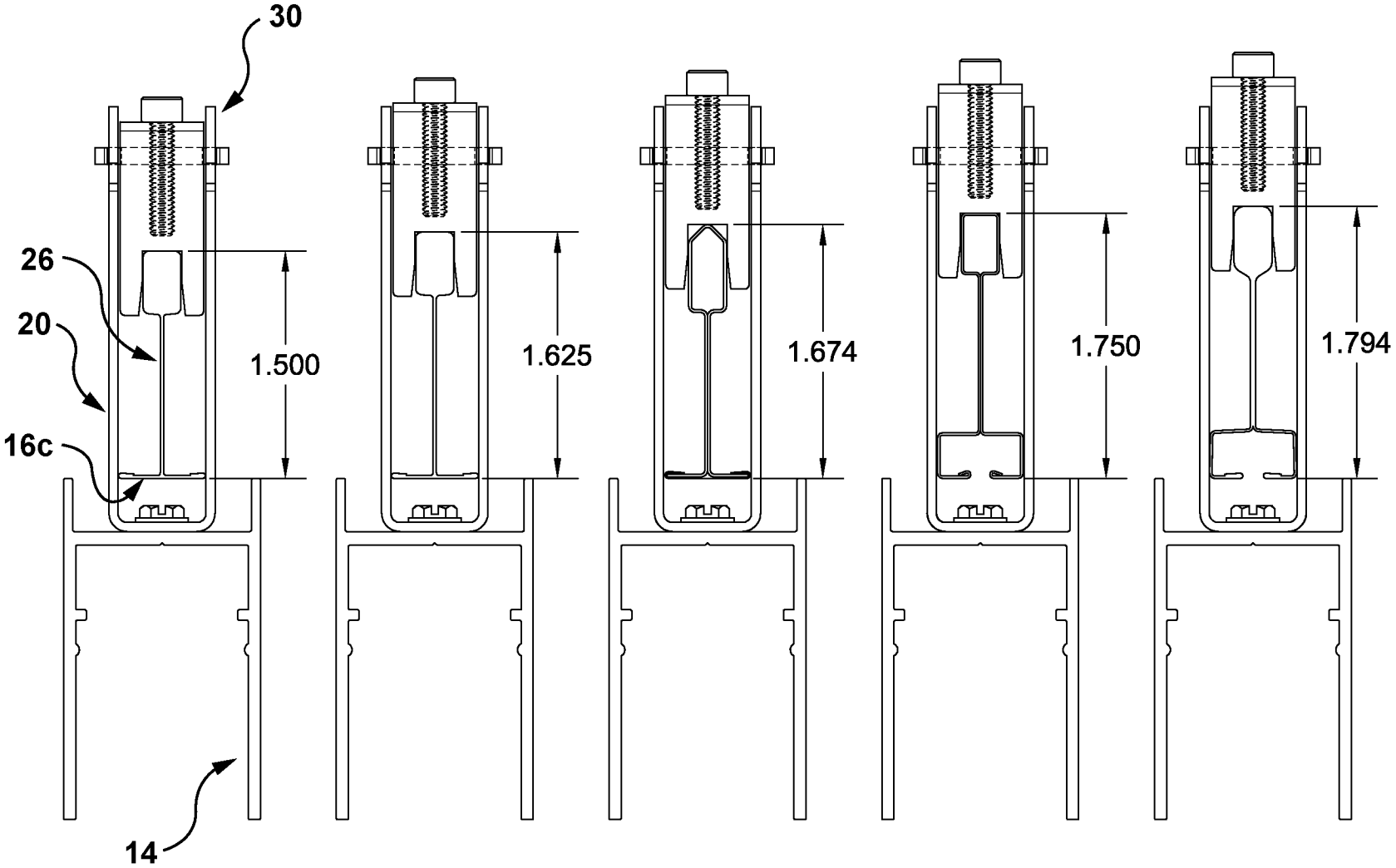
FIGS. 23 and 24 are schematic cross sectional views of a number of light fixture structure configurations.
Figure 24:
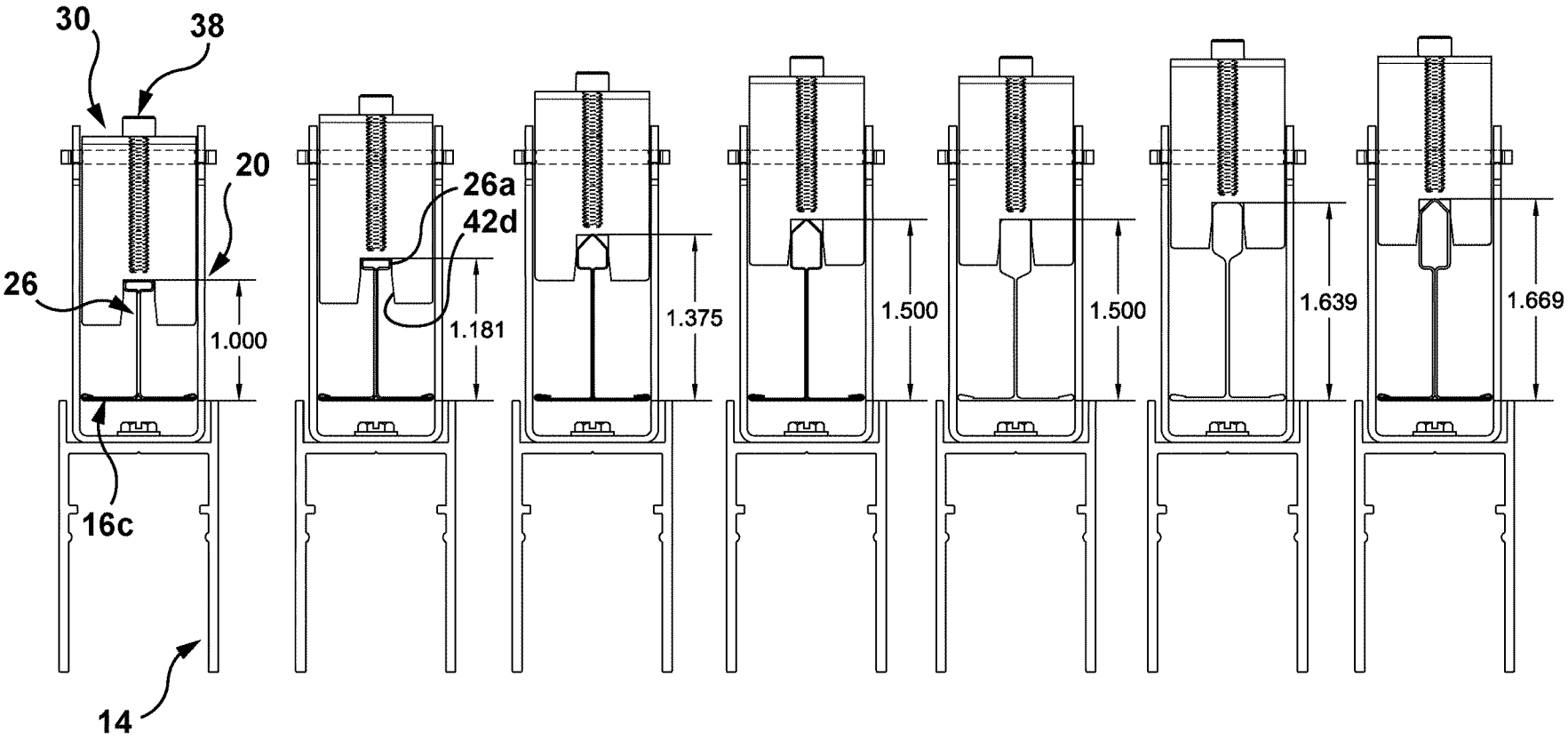

FIGS. 23 and 24 show different cross sections of installations of the type shown in FIG. 1 in which the frame 14 engages the lower boundary 16*c*, the anchor structure 20, the clamp structure 30 may cooperate with the frame 14 to accommodate a range of configurations of grid segment 26. As can be seen in FIG. 24, the saddle recess 42*b* may be provided with a bevel or flare shown on each side of the grid segment at 42*d*, or other configurations which may aid in both installing the clamp structure 30 on grid segment 26, and the sliding of the clamp structure 30 along the upper region 26*a* of the grid segment 26. Meanwhile, the saddle recess may be configured to accommodate a range of differently shaped upper regions 26*a* of the grid segment 26.

The present disclosure includes example embodiments of a light fixture structure, and may also be applied to example embodiments for other ceiling structures such as grid mounted acoustic panels, light shading, filtering, reflecting or blocking panels, or ceiling mounted audio appliances such as microphones and speakers, and video appliances such as cameras, projectors, screens and the like.

While the present disclosure describes various exemplary embodiments, the disclosure is not so limited. To the contrary, the disclosure is intended to cover various modifications and equivalent arrangements, as will be readily appreciated by the person of ordinary skill in the art.

The invention claimed is:

1. A device for mounting a light fixture structure to a ceiling grid, comprising an anchor structure configured to extend from the light fixture structure, the anchor structure having a pair of arm structures which are spaced to receive a ceiling grid segment therebetween at an anchor location on the ceiling grid and to be positionable with the light fixture structure in a mounted position adjacent a lower region of the ceiling grid, the arm structures having respective distal regions configured to be accessible from an upper region of the ceiling grid when the light fixture structure is in the mounted position, a clamp structure configured to traverse relative to the distal regions to couple with the respective distal regions and thereafter to be transferable between a released position and a locked position, wherein in the locked position, the ceiling grid segment is held between the anchor and clamp structures thereby to place the light fixture structure in the mounted position.

2. The device as defined in claim 1, wherein the clamp structure is configured to traverse laterally relative to the distal regions along the upper region of the ceiling grid segment to couple with the respective distal regions.

3. The device as defined in claim 1, wherein the clamp structure is configured to engage the distal regions with relative movement along a travel path aligned with an upper surface of the ceiling grid segment.

4. The device as defined in claim 1, wherein the distal regions and the clamp structure include respective complementary coupling structures which are engageable via the relative sliding movement along the travel path.

5. The device as defined in claim 3, wherein the distal regions and the clamp structure include respective complementary coupling structures which are restricted for engagement via the relative movement along the travel path.

6. The device as defined in claim 4, wherein the complementary coupling structures provide respective male and female coupling structures on the clamp structure and/or the distal regions.

7. The device as defined in claim 6, wherein the clamp structure includes a clamp body, and the male structures include a pair of opposed outwardly extending tabs, and each of the distal regions include aligned female structures as passages with each open to receive a corresponding tab.

8. The device as defined in claim 7, wherein the clamp structure includes a latch movable relative to the clamp body with the opposed tabs integrated therewith, and a drive member configured to displace the latch relative to the clamp body.

9. The device as defined in claim 8, wherein the latch includes a pair of opposed neck regions respectively adjacent the tabs.

10. The device as defined in claim 9, wherein each of the passages includes a recess to receive a corresponding neck region in the locked position.

11. The device as defined in claim 1, wherein the clamp structure includes a pair of legs to engage toward and engage the upper surface of the ceiling grid segment.

12. The device as defined in claim 11, wherein each leg includes a saddle recess to receive the ceiling grid segment therein at the upper surface thereof.

13. The device as defined in claim 7, wherein each passage includes an opening toward the travel path to receive the corresponding tab and a barrier to limit further travel thereof once received in the passage.

14. The device as defined in claim 1, wherein at least one of the arm structures includes a passage to receive a tension member for securing the anchor structure to a ceiling structure above and/or adjacent the ceiling grid.

15. The device as defined in claim 14, wherein the at least one arm structure has one or more boundaries, and an offset web portion extending outwardly from at least one of the one or more boundaries.

16. The device as defined in claim 14, wherein each of the arm structures includes a passage, the passages being aligned and laterally offset relative to the travel path and beyond a position in which each of the neck regions is aligned with a corresponding recess.

17. The device as defined in claim 16, wherein each passage includes an opening toward the travel path to receive the corresponding tab and a terminus to limit further travel beyond a location at which the neck region is aligned with the corresponding recess, and the corresponding passage is positioned beyond the terminus.

18. A ceiling fixture structure mountable on a ceiling grid, comprising a housing structure, a pair of arm structures extending outwardly therefrom and which are spaced to receive a ceiling grid segment therebetween at an anchor location on the ceiling grid and to be positionable with the ceiling fixture structure in a mounted position adjacent a lower region of the ceiling grid, the arm structures having respective distal regions configured to be accessible from an upper region of the ceiling grid, a clamp structure configured to traverse relative to the distal regions to couple with the respective distal regions and thereafter to be transferable between a released position and a locked position, wherein in the locked position, the ceiling grid segment is held between the anchor and clamp structures thereby to place the ceiling fixture structure in the mounted position.

19. A method for mounting a light fixture structure to a ceiling grid, comprising:

a) providing the light fixture structure and the clamp structure of claim 1;

b) orienting the light fixture structure with the arm structures extending along opposite side surfaces of the ceiling grid segment to expose the distal regions above the upper region of the ceiling grid segment;

c) traversing the clamp structure in the released position, to engage the distal regions; and d) transferring the clamp structure to the locked position.

* * * * *